United States Patent [19]

Minardi et al.

[11] 4,439,988

[45] Apr. 3, 1984

[54] RANKINE CYCLE EJECTOR AUGMENTED TURBINE ENGINE

[75] Inventors: John E. Minardi; Maurice O. Lawson; Hans P. von Ohain; Ival O. Salyer, all of Dayton, Ohio

[73] Assignee: University of Dayton, Dayton, Ohio

[21] Appl. No.: 204,413

[22] Filed: Nov. 6, 1980

[51] Int. Cl.[3] ..... F01K 25/06

[52] U.S. Cl. ..... 60/649; 60/673

[58] Field of Search ..... 60/649, 673, 674

[56] References Cited

U.S. PATENT DOCUMENTS

| | | | |
|---|---|---|---|
| 32,149 | 4/1861 | Rogers et al. | 60/674 |
| 2,151,949 | 3/1939 | Turner | 60/649 |
| 3,006,146 | 10/1961 | Jackson | 60/674 X |
| 4,249,385 | 2/1981 | Bissell | 60/649 X |

FOREIGN PATENT DOCUMENTS

| | | | |
|---|---|---|---|
| 9044 | of 1898 | United Kingdom | 60/674 |

*Primary Examiner*—Allen M. Ostrager
*Assistant Examiner*—Stephen F. Husar
*Attorney, Agent, or Firm*—Biebel, French & Nauman

[57] ABSTRACT

Energy is extracted from a high-temperature high-pressure working fluid by augmenting flow of the working fluid with a flow of gas having a molecular weight less than the fluid, utilizing some of the energy from the working fluid to induce addition and mixture of the gas in an ejector creating a flow of the mixed fluids having a greater mass and lower temperature than the initial flow of working fluid and supplying the mixed fluids to a turbine which converts the energy in the mixed fluids into mechanical energy. The exhausted fluids are separated and at least the augmenting gas is recycled to the ejector. The gas is selected from the group consisting of hydrogen, helium, nitrogen, air, water vapor, or an organic compound having a molecular weight less than the working fluid, and the working fluid is selected from the group consisting of an inorganic element, an inorganic compound, or a fluorocarbon.

13 Claims, 7 Drawing Figures

RANKINE CYCLE EJECTOR AUGMENTED TURBINE ENGINE

BACKGROUND OF THE INVENTION

Energy conservation through mandated energy efficiencies and straightforward cutbacks in usage by the public and private sectors can clearly generate important fuel savings. However, really significant national gains can be realized only through timely development and implementation of a range of advanced technology concepts that promise very high efficiencies. Turbine engines are widely used for many different applications but, in the past, this use has been almost entirely limited to engines of the higher power range, e.g. greater than 1000 kW.

In recent years the most successful approach taken to extend the application of the turbine to very small power levels has been to utilize a high-molecular-weight vapor as the working fluid. This approach has been effective down to power levels of about 10 kW (bottoming cycles in truck engines). However, the turbine sizes become very small and the rotational velocities very high. Therefore, to operate below this level, additional approaches have been taken, such as the application of less-efficient, partially-admitted turbines and/or extremely low working pressures. These approaches have not been fully satisfactory and generally have been limited to special applications.

Two problem areas have been dominant in the development of high-efficiency, very-low-power turbines. One has been the problem of excessive heat loss in the high temperature section, resulting in reduced operating efficiency. The other has been the adverse effects of small turbine diameters, e.g., low efficiency and extremely high rpm.

An ejector used to pump a fluid is usually thought of as inefficient since that has been the case in most previous applications. However, U.S. Air Force studies (Lawson, M. O., "Electrofluid Dynamic Generators and Cycle Performance for Optimally Matched Ejectors," AFAPL-TR-76-111, Wright-Patterson Air Force Base, Ohio, July 1976; Huberman, M., et al., "Study on Electrofluid Dynamic Power Generation," ARL-TR-75-0200, June 1975) indicate flow transfer efficiencies in excess of 90 percent for high-volume-flow-ratio ejectors that meet two major operating criteria. First, the two flows have nearly equal speed at mixing, and second, the Mach number of the larger volume flow, which is being "pumped," should be low subsonic. For a high-pressure-ratio cycle (e.g., a Rankine cycle), both of these conditions can be met by the selection and matching of the two working fluids: one is the thermodynamic fluid which should be of high molecular weight and the other is the turbine cycle fluid which should be of extremely low molecular weight, e.g., hydrogen or helium.

SUMMARY OF THE INVENTION

The present approach provides maximal alleviation in both of these problem areas. It does this by augumenting the primary gas flow going into the turbine with a light-gas. The two fluids are efficiently mixed in an ejector and then admitted into the turbine. The turbine extracts the available energy, that was originally only in the primary fluid, with a much smaller pressure drop than would be required if only the primary fluid were used. In addition, the stagnation temperature of the mixed fluid is much lower than the stagnation temperature of the primary fluid alone. The flow-augmented, ejector turbine can be used in a closed cycle by separating the cycle into two loops, (1) A thermodynamic portion with a high molecular weight fluid having a low volume flow, high temperature ratio; and (2) a gas portion with a low molecular weight fluid having a high volume flow, low temperature, which expands through a very low pressure ratio.

A significant feature of the invention is that the hot primary working fluid mixes with a large volume of secondary fluid before coming into contact with any moving parts in the turbine. Consequently, there is a substantial drop in temperature, and the rotating machinery comes into contact only with relatively low temperature fluids. Further, the thermodynamic cycle can be run at higher temperatures than are currently used, permitting more efficient overall performance.

The combination of an ejector with the turbine produces a number of major advantages:

1. The turbine operates with a small pressure drop compared to a turbine of the same power but not using the ejector.
2. The turbine operates in a low temperature environment.
3. The efficient and effective very-small-power-turbine range is greatly extended to lower powers.
4. Manufacturing costs can be reduced.
5. Highest temperature heat sources can be utilized with a concomitant higher efficiency.
6. External combustion can be used in closed cycles which will permit the use of alternate fuels with reduced environmental impact.
7. Turbine rpm can be reduced.
8. Larger turbines can be used in the very small power class.
9. Lower turbine bearing loads are obtained.
10. Extremely long lifetime capability is realized.
11. Maintenance costs can be reduced.
12. Reliable, long-term operation can be achieved.

The advantages are primarily the result of the combination of the ejector and turbine which produces greatly increased volume flows over a straight vapor cycle turbine, as well as decreased temperature and pressure drops in the turbine. Only the vaporizer and supersonic nozzle(s) must be subjected to high temperature and/or pressure. Although the engine can be used to drive any load matched to its power size, the most attractive applications foreseen are in the low-to-moderate power class (1–1000 kW), that can have a high temperature heat source available.

One especially attactive application is a fuel-fired heat pump. Such heat pumps can offer an overall Coefficient of Performance (COP, ratio of heating/cooling effect to energy in the fuel) of 1.8 for heating and a cooling COP of 1.2. The better gas furances have a steady-state COP of 0.7 (or a steady-state efficiency of 70 percent with a seasonal value of 40 to 60 percent), while an electric drive air-to-air heat pump will have a seasonal COP between 0.6 to 0.8 for both heating and cooling if the COP is based on the fuel input at the power plant. Thus, a fuel-fired heat pump can potentially more than halve the fuel needed for heating and cooling buildings.

One critical need for implementing the fuel-fired, heat-pump concept for single family dwellings is the development of efficient, long-life, heat engines in small sizes (less than 10 kW) and the ejector-augmented, light-gas-flow turbine used in a Rankine-cyle, according to the invention is an excellent candidate for filling this critical need.

Many other applications can be envisioned for these turbines as waste-heat utilization; cogeneration; high-temperature-rejection, bottoming cycles; military ground power; or engines for autos, tractors, etc. Automobile engines are attractive since the higher operating efficiency that is inherent in this invention can be combined with other desirable aspects including nonspecific fuel requirement, cleaner burning (lower emissions), longer life, and reduced maintenance.

In all of the above, the low maintenance, long-life characteristics of turbines is highly desirable. Further, the present cycle promises even longer life because of the low temperature in the turbine and improved efficiencies by making feasible the use of the highest-temperature, heat source.

The primary object of the invention, therefore is to provide a method of operating a light gas flow turbine engine, preferably in a closed Rankine-type cycle, wherein the mass flow of the thermodynamic working fluid is augmented in an ejector by a mass flow of a light gas whose molecular weight is less than that of the working fluid; to provide a turbine engine which receives its working fluid from such an ejector; to provide such a process and engine wherein the light gas is recovered and recycled to the ejector; to provide such a process and engine wherein the thermodynamic fluid is also recovered and recycled; and to provide such a process and engine wherein the working fluid is an inorganic element or compound, having a molecular weight substantially less than the molecular weight of the working fluid.

Other objects and advantages of the invention will be apparent from the following description, and accompanying drawings and the appended claims.

DESCRIPTION OF PREFERRED EMBODIMENT

Although other cycles could be used, the thermodynamic cycle most suited for use with the ejector-turbine is a closed, nonregenerative, Rankine-type cycle which will require the following components.

Liquid pump—10
Vaporizer—12
Ejector—15
Turbine—18
Heat exchanger/condenser—20
Droplet separator—22
Thermodynamic fluid (higher molecular weight)—in loop 25
Turbine cycle fluid (lower molecular weight)—in loop 28

Figure 1:
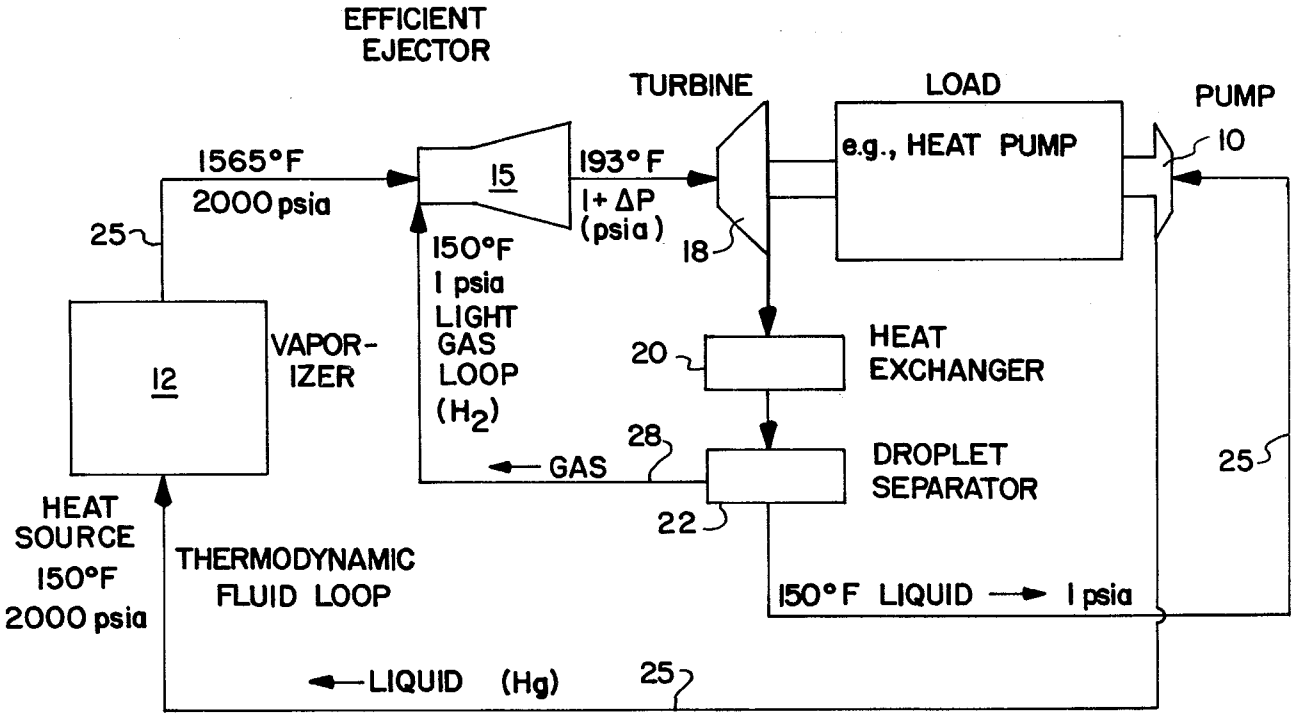
FIG. 1 is a schematic diagram of the engine and related system compenents.
Figure 2:
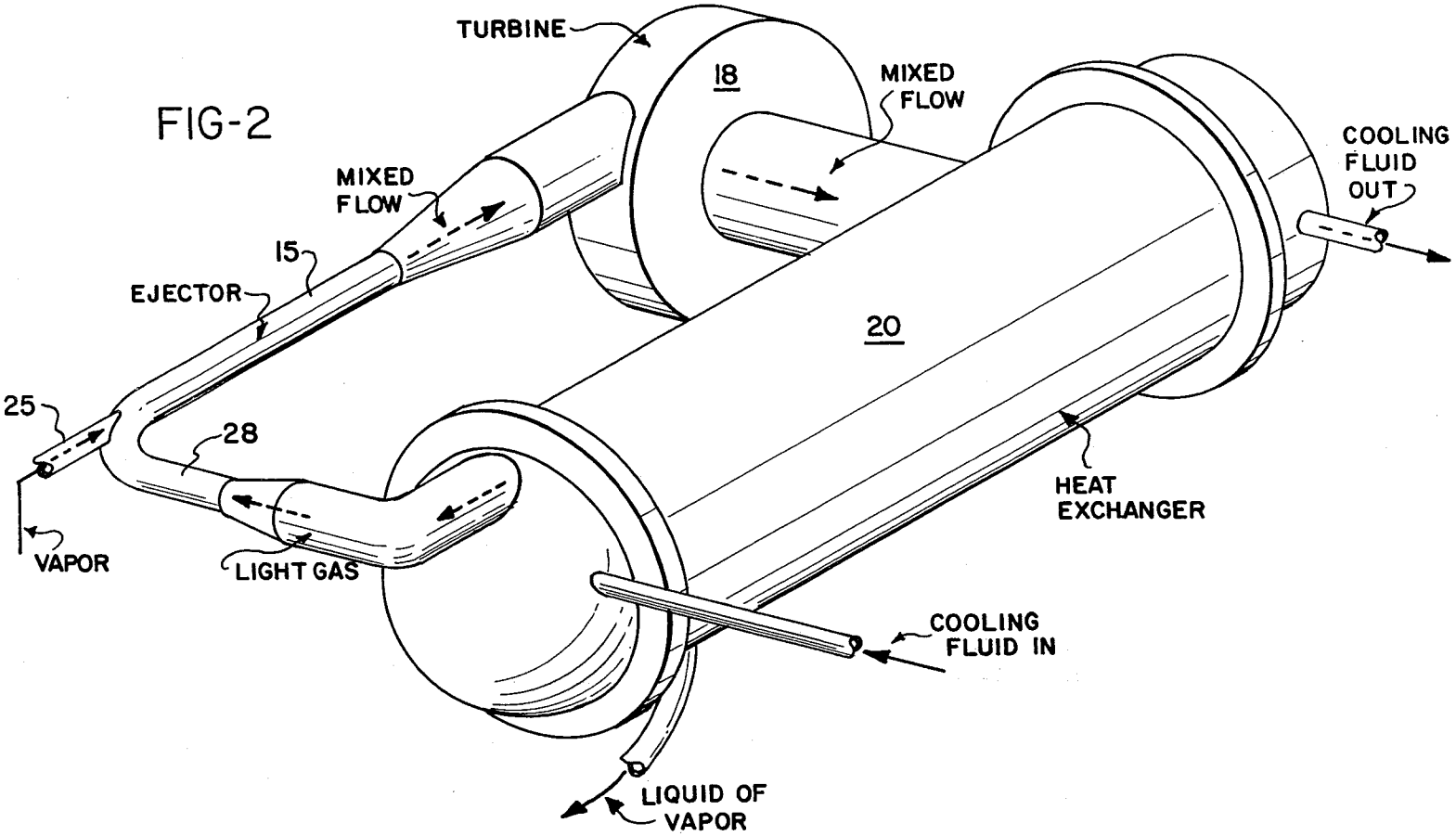
FIG. 2 is a perspective view of a typical configuration of the principal engine components.
Figure 3:
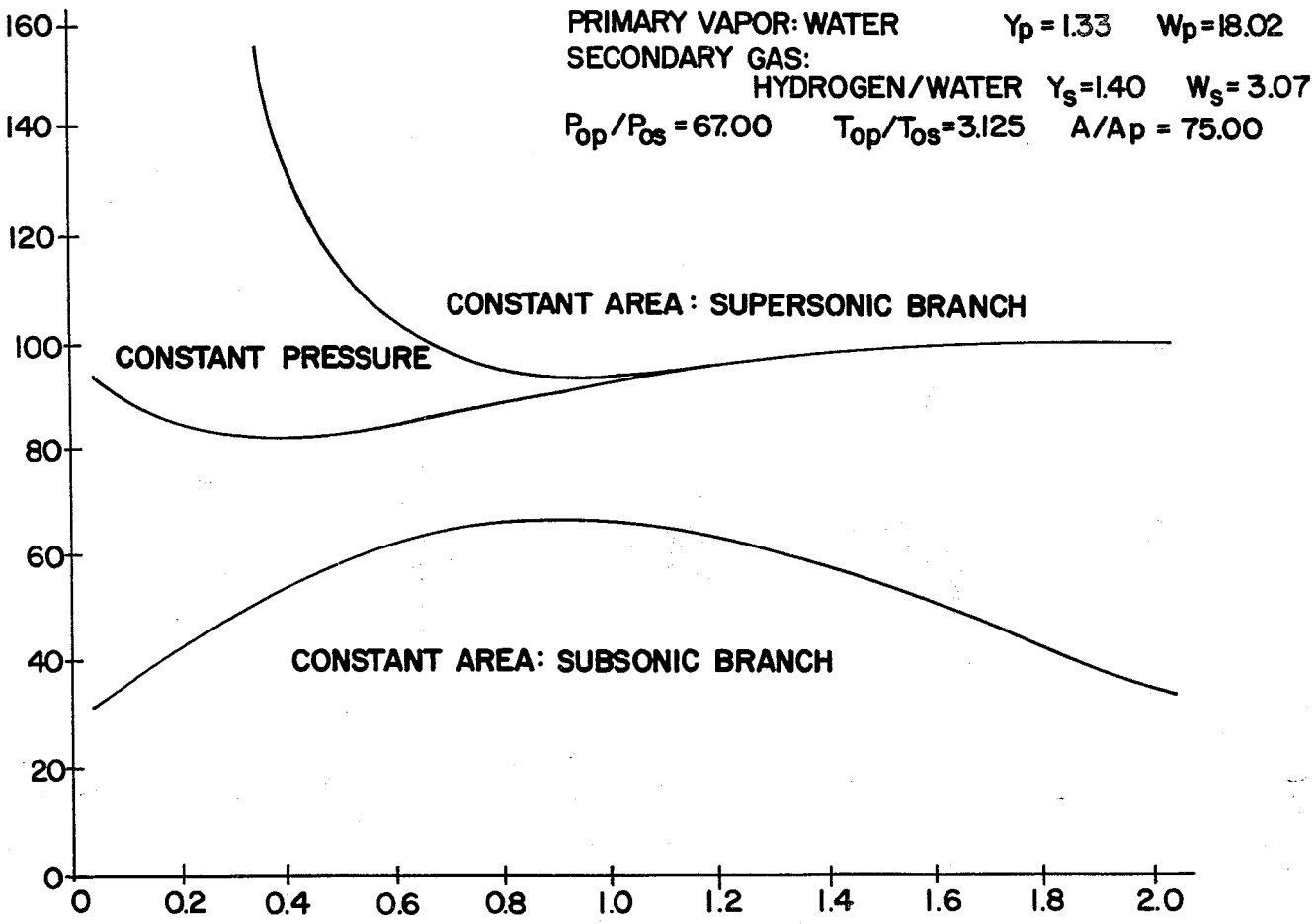
FIG. 3 is a diagram illustrating flow transferring efficiencies for high-volume-flow-ratio ejectors.
Figure 7:
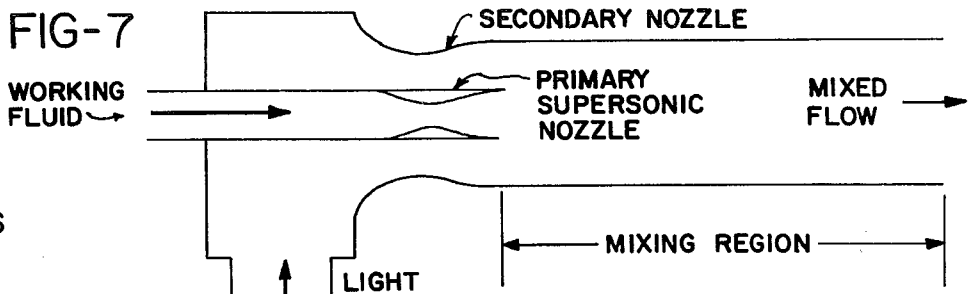
FIG. 7 is a schematic diagram of the ejector.

FIG. 1 provides a schematic of the cycle components. At the vaporizer 12, the thermodynamic fluid is heated by any available fuel (gas, oil, coal, wood, solar, etc.). The fluid then flows to the ejector nozzle(s) (FIG. 7) where it is expanded supersonically and efficiently transfers energy to the light gas which may be at a subsonic velocity. It is desirable to have a relatively large volume flow rate of the light gas. At the nozzle exit the vapor merges with the low-molecular-weight gas at nearly equal speeds but with a high ratio of Mach numbers. The large Mach number ratio is the result of the large difference in molecular weights. The ejector channel to nozzle area ratio may be very large, on the order of 100, which previous studies have shown to be feasible while providing high ejector efficiency (in the order of 90 percent). After mixing, the flow may be diffused to a velocity corresponding to optimal turbine blade angle values. Following the turbine 18 some additional diffusion occurs before entering the heat exchanger-condenser 20. In cooling the light-gas and vapor combination to its original temperature, liquid droplets of the vapor form and a droplet remover section 22 may be required. The separated liquid is pumped to the vaporizer, while the light gas (with a small amount of vapor) returns to the ejector, completing the cycle.

Mercury-Hydrogen System

This example demonstrates the cycle's ability to utilize a relatively large turbine diameter in application to a very small-power, three-kilowatt turbine. Mercury and hydrogen are used as the thermodynamic working fluid and the light gas, respectively, while the following operating values have been chosen.

Heat rejection temperature = 150° F.
Gas ($H_2$) pressure—1 psia
High vapor pressure = 2000 psia
High vapor temperature = 1565° F.

The isentropic change in enthalpy of the expanding vapor is $$80 \text{ Btu/lb}$$

and the actual enthalpy drop may be about 96 percent of these values.

The density of the vapor at the nozzle exit is $$\rho_{Hg} = 0.035 \text{ lb/ft}^3$$

and the ratio of vapor density to gas density is $$\frac{\rho_{Hg}}{\rho_{H2}} = 106$$

The turbine head is related to the vapor velocity (spouting) head by the expression $$\Phi = \frac{\eta_t \times v_p^2/2}{(\bar{m} + 1)(U \cdot \Delta\mu)}$$

where
$\eta_t$ = turbine stage efficiency
$v_p$ = nozzle velocity
$\bar{m}$ = vapor mass flow/gas mass flow
$U \times \Delta u/g$ = turbine head.

For an ejector loss coefficient of ten (10) percent and a ratio of vapor flow area to gas flow area of 0.01, the ejector efficiency is $$\eta_e = 0.85$$

while $$\phi = 0.91$$

and $$\dot{m}_p = 0.051 \text{ lb/s} = \text{vapor mass flow}$$

$$\dot{m}_s = 0.040 \text{ lb/s} = \text{gas mass flow}$$

so that $$\bar{m} = 1.29.$$

Substitution of these values into the above expression, relating the turbine head to the spouting head, and for a turbine stage efficiency of 85 percent, $$U \cdot \Delta u = 31 \text{ Btu/lb}$$

which is significantly lower than the isentropic spouting head of 80 Btu/lb. This reduction is very favorable in that it corresponds to a lower rpm; the reduction is mainly due to the augmenting of the vapor mass flow. The augmentation in this example corresponds to the factor $$\frac{(\dot{m}_s + \dot{m}_p)}{\dot{m}_p} = 1.78.$$

The fully admitted axial flow turbine class corresponds to the very highest efficiency turbine types. For this class of turbines, the optimum pair of values (Balje, O. E., "A Study on Design Criteria and Matching of Turbomachines: Part A-Similarity Relations and Design Criteria of Turbines," ASME #60WA230) of specific diameter, $D_s$, and specific speed, $N_S$, is $$D_S = 0.8$$

$$N_S = 150$$

where $$N_S = \frac{N\sqrt{V}}{H_{ad}^{3/4}}$$

$$D_S = \frac{D\,H_{ad}^{1/4}}{\sqrt{V}}$$

and $$N = \text{rpm}$$

$$D = \text{Diameter in feet}$$

where $$H_{ad} = \frac{U \cdot \Delta\mu}{g} = 2.45 \times 10^4 \frac{\text{ft. lb}}{\text{lb}}$$

and $$V = 121 \text{ ft}^3/\text{s}.$$

Substitution of the above values into the equation for specific speed and solving for the angular velocity, $$N = 26{,}700 \text{ rpm}$$

and in a similar way, solving for the axial flow turbine diameter, $$D = 0.703 \text{ ft (8.4 in.)}$$

The turbine type which could be considered the "turbine type of choice" by design engineers for small power applications is the radial inflow turbine. In this case for highest efficiency, $$D_S = 1.7$$

$$N_S = 65$$

so that $$N = 11{,}570$$

$$D = 1.49 \text{ ft (18 in.)}.$$

can be reduced to a value of 6 inches by increasing the gas pressure level from the present value of 1 psia to 9 psia.

It is significant to compare the above values with those that would be provided by nonaugmented cycles for Mercury and for the same conditions, In this case, $$V = 1.23 \text{ ft}^3/\text{s}$$

$$H_{ad} = 5.1 \times 10^4 \frac{\text{ft. lb}}{\text{lb}}$$

For the radial inflow turbine, the specific values were $$D_S = 1.7$$

$$N_S = 65.$$

So that, $$N = 199{,}000 \text{ rpm}$$

$$D = 0.125 \text{ ft} = 1.51 \text{ in.}$$

This size turbine would be inappropriate for operating at high temperatures and also would not fulfill the requirements for an inexpensive long life turbine.

The overall cycle efficiency, $\eta$, for the light gas flow augmented turbine cycle, neglecting the slight amount of pump work, is the product of the following efficiencies:

| | |
|---|---|
| Combustion: | .85 |
| Nozzle: | .96 |
| Ejector: | .85 |

-continued

| | |
|---|---|
| Turbine: | .85 |

and the ratio of the isentropic head to heat added;

$$\frac{h}{H} = \frac{80}{170} = .47$$

so that $$\eta = 28 \text{ percent.}$$

This is a very high efficiency for this power class. One of the reasons for this is the ability to run the turbine fully admitted. Also, it should be pointed out that the application of very high temperatures and pressures can yield significantly increased values of efficiencies. In addition, one can expect small increases in ejector and turbine efficiences for larger turbines in the 100 kW and larger power classes.

In the foregoing system mercury is used to pump hydrogen. This combination appears to be one of the best for performance but it is probably not satisfactory for use in the home. Other, more-suitable combinations of fluids for home applications can be found: e.g., water and hydrogen, or FC-75 and helium.

The various values of pressure and temperature, for the example calculation of a 3 kW engine used to drive a heat pump, are shown on FIG. 1. Although temperature out of the vaporizer is 1565° F., the inlet total temperature to the turbine is only 193° F. The turbine speed and diameter would depend on the type of turbine chosen. If it were a radial inflow turbine the diameter would be six inches for the nine psia pressure in the light gas loop and the turbine would run at 34,710 rpm. After accounting for losses in the various components (including the ejector) the overall cycle efficiency will be about 28 percent for this 3 kW turbine, an excellent value of efficiency for this power class.

As shown in FIG. 1, the turbine operates in a very favorable low temperature environment which is essentially at the heat rejection temperature of the cycle, with greatly augmented flow and with correspondingly reduced total pressure drop. The turbine could be located after the droplet separator or immediately following the ejector's diffuser, where the flow is very low speed and may consist of a low temperature mixture of gas, vapor, and submicron droplets. Experimental and theoretical studies indicate that such small diameter droplets follow the streamlines of the flow and would not impact and erode the turbine blades. In most fluid combinations the submicron liquid droplets would not be present in the mixed flow entering the turbine and there would be no need for a droplet separator before the turbine.

Other Light Gas Fluids

The next best choice to hydrogen from the standpoint of performance is helium. Because of its inert behavior, it makes an ideal light gas for use in the cycle. Thus, for most commercial applications it is expected helium would be chosen. Since only small quantities of the light gas are needed, the high cost of helium would not be a great disadvantage. For special purpose applications, such as in space, the somewhat greater performance of hydrogen may be important. Light gases other than hydrogen and helium could also be used in special applications but would not provide as high efficiency; examples include Nitrogen, Methane, and Tetrafluoro Methane.

Other Thermodynamic Working Fluids

The selection of suitable thermodynamic working fluids is more complex than in the case of the light gas. There are more candidate fluids to choose from and trade-off's of performance versus cost, toxicity, and maximum operating temperature must be evaluated. The working fluids may be selected from either inorganic or organic materials.

Inorganic Elements and Compounds

From the standpoint of operating efficiency, Mercury [molecular weight (mol. wt.) of 200, boiling (B.P.) of 356° C.] combines many desirable properties of the ideal working fluid; high molecular weight, thermal stability, low freezing point, high value of the ratio of specific heats, etc. However, because of possible toxicity problems, Mercury would be undesirable for general public use as the primary working fluid, as has been noted above. This does not eliminate Mercury from consideration in special military or space applications where conditions of use can be closely controlled and monitored. Cadmium Iodide (mol. wt. 366, B.P. 713° C.) as a working fluid has the advantage of higher molecular weight than Mercury. Also, the higher boiling point results in a lower vapor pressure at practical heat rejection temperatures. Likewise elemental Iodine (mol. wt. 253, B.P. 184° C.) has some of the basic characteristics needed for the working fluid, but the disadvantage of a high melting point (113° C.) as well as toxicity problems.

Importantly, it has been found that good efficiency can also be obtained using water (mol. wt. 18, B.P. 100° C.) as the primary working fluid and hydrogen as the light gas, thus water is an excellent choice for many applications.

Water-Hydrogen System

Reasonable ejector efficiencies are also achieved with water pumping hydrogen/water (the light gas contains sufficient water vapor to raise the molecular weight of the returning mixture to 3.07). The efficiency (based on an expansion to the secondary stagnation pressure) is presented on FIG. 4. It is clear that higher ejector efficiencies are possible if the supersonic branch can be achieved in practice or if the constant pressure solution can be achieved, but it is readily possible to achieve the subsonic solution and an efficiency of 67 percent can be obtained, at a secondary Mach number of 0.9. The cycle shown on FIG. 5 thus is for water driving hydrogen/-water, showing of course, only the state of the primary water and not the total mixed flow.

Figure 5:
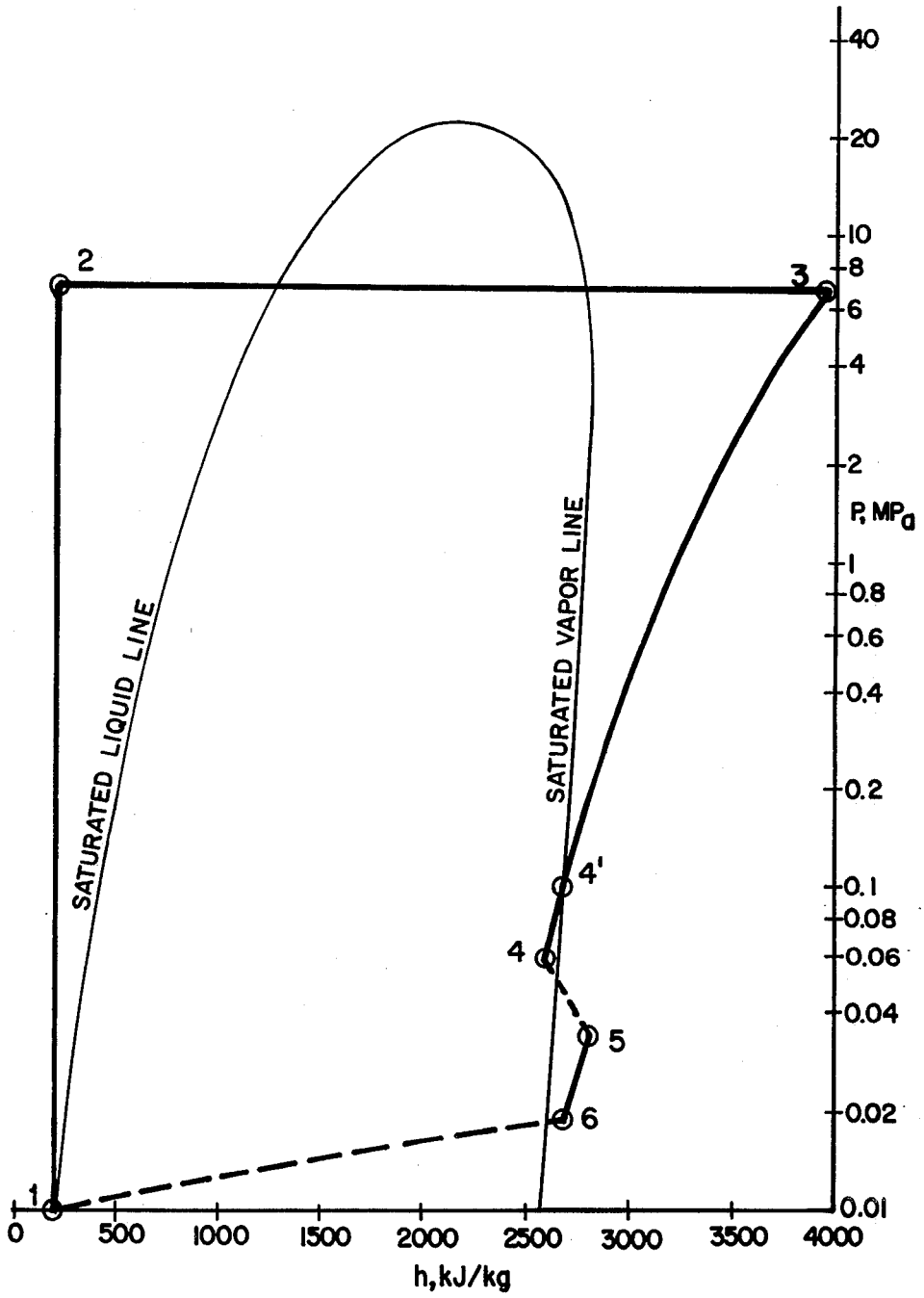
FIG. 5 is a diagram showing a cycle for a water driving hydrogen/water configuration.

Point 1 on FIG. 5 is the liquid obtained from the condensor at a pressure of 0.1 MPa. Point 2 gives the inlet conditions to the boiler and Point 3 gives the stagnation conditions of the primary fluid at the inlet to the ejector primary nozzle. Point 4 gives the thermodynamic conditions at the exit of the primary nozzle (conditions at the entrance of the ejector). After mixing in the ejector, the water vapor cools to the conditions at Point 5. The process from Point 4 to Point 5 is an irreversible mixing process. The pressure at Point 5 is the partial pressure of the primary flow in the mixed flow. The process from Point 5 to Point 6 represents a further expansion of the mixed flow in the turbine. The mixed flow is expanded to the secondary stagnation pressure (here assumed to be 0.1 MPa). Again, the pressure at Point 6 is the partial pressure of the primary water vapor in the mixed flow. A final irreversible process connects Point 6 to Point 1. This process is equivalent to the common dehumidification process.

Figure 4:
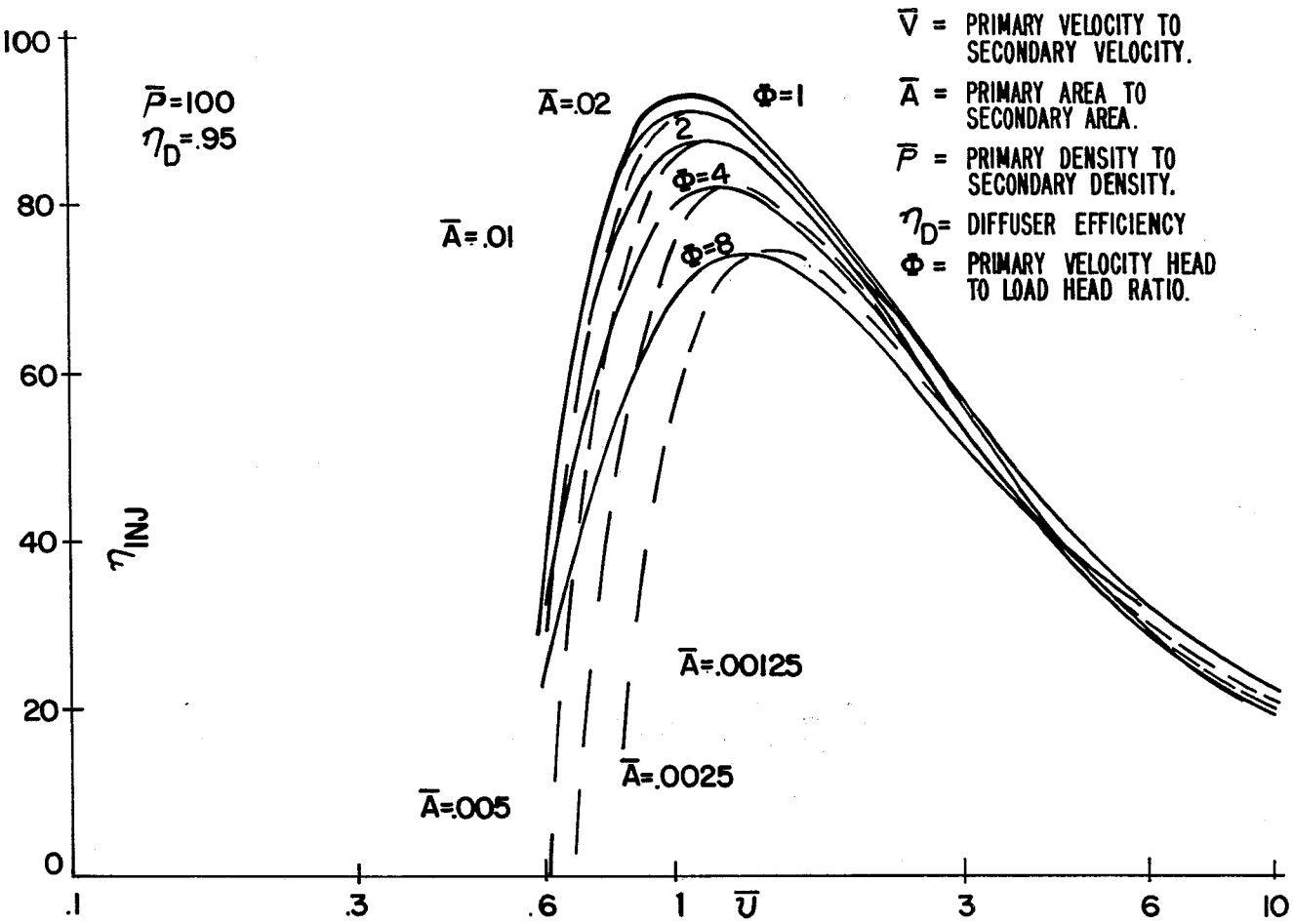
FIG. 4 is a diagram illustrating ejector efficiencies.

It is possible to calculate the efficiency of the cycle for ejector operation for either of the three curves presented on FIG. 4. The peak efficiency on the subsonic branch occurs at an inlet secondary Mach number of about 0.9 and the efficiency of the constant pressure ejector is 91 percent and on the supersonic branch of the constant area ejector and efficiency is 95 percent. These efficiencies are based on expansion of the primary fluid to the stagnation pressure of the secondary fluid which is assumed to be 0.1 MPa (about 1 atmosphere). This point is labeled 4' on FIG. 5.

The maximum efficiency of the cycle with an ejector is $$\eta = \frac{(h_3 - h_{4'})\,\eta_{ej}}{h_3 - h_2}$$

now $$h_3 - h_2 = 3950 - 200 = 3750 \text{ kJ/kg}$$

and $$h_3 - h_{4'} = 3950 - 2680 = 1270.$$

The maximum efficiencies then can be calculated for the three ejector efficiencies:

1. Subsonic branch: $=1270/3750\times 67\times 22.7\%$
2. Constant pressure: $=0.339\times 91=30.8\%$
3. Supersonic branch: $=0.339\times 95=32.2\%$ Assuming the following component efficiencies: Combustion 85%; Nozzle 96%; and Turbine 85%; the overall product of the three efficiencies is 69.4 percent. Consequently, the overall thermodynamic efficiencies for the three cases of ejector operations can be established as:

1. Subsonic branch: $22.7\times 0.694=15.7\%$
2. Constant pressure: $30.8\times 0.694=21.4\%$
3. Supersonic branch: $32.2\times 0.694=22.3\%$ Thus, even for operation with steam efficiencies in excess of 20 percent for the small size turbines are achievable. Since these turbines would be operating in a low temperature environment at lower rpm (as compared to a turbine without the light gas), a long and reliable life can be expected from the turbines.

In applications where it is not necessary to recover and recycle the working fluid, $CO_2$ gas (mol. 25. 44, B.P.-78.5) from a separate high temperature source can be efficiently utilized as the working fluid in combination with hydrogen as the light gas or even air as the light gas.

Organic Working Fluids

Organic compounds also are suitable for use as the thermodynamic working fluid although they must in general be used at lower operating temperatures than the inorganic compounds. Thus, the efficiency of the overall cycle will be somewhat lower than for inorganic compounds, such as $H_2O$.

However, there are important applications (e.g., waste heat recovery) where lower operating temperatures are required. For the lower operating temperatures the temperature stability of the organic compounds is adequate, and they have the advantage of higher molecular weight than $H_2O$ or most other inorganic fluids.

The perfluorinated organic compounds (fluorocarbons) constitute a special class of organic compounds that combine high molecular weight (e.g., 400) with a relatively low boiling point (e.g., 120° C.) and good thermal stability. These fluorocarbon compounds, such as sold by 3-M Corporation under the trade name of FC-75, are inert, nontoxic, and do not deplete the ozone layer (if emitted into the atmosphere). The fluorocarbon working fluid can be combined with low molecular weight light gases such as hydrogen or helium (preferred), however, low molecular weight gases such as Nitrogen, air, methane, or tetrafluoromethane may also be used in specific cases.

Thus, a suitable combination for lower temperature heat sources is FC-75 with Helium/FC-75 as the light gas (the light gas contains sufficient FC-75 vapor to raise the molecular weight of the returning mixture to 7.35 when it is at 1 atmosphere and to 37.47 when it is at 1/10 of an atmosphere).

The maximum ejector efficiency for the mixture returning at 1 atmosphere is 93 percent and 82 percent for the mixture returning at 1/10 atmosphere.

Figure 6:
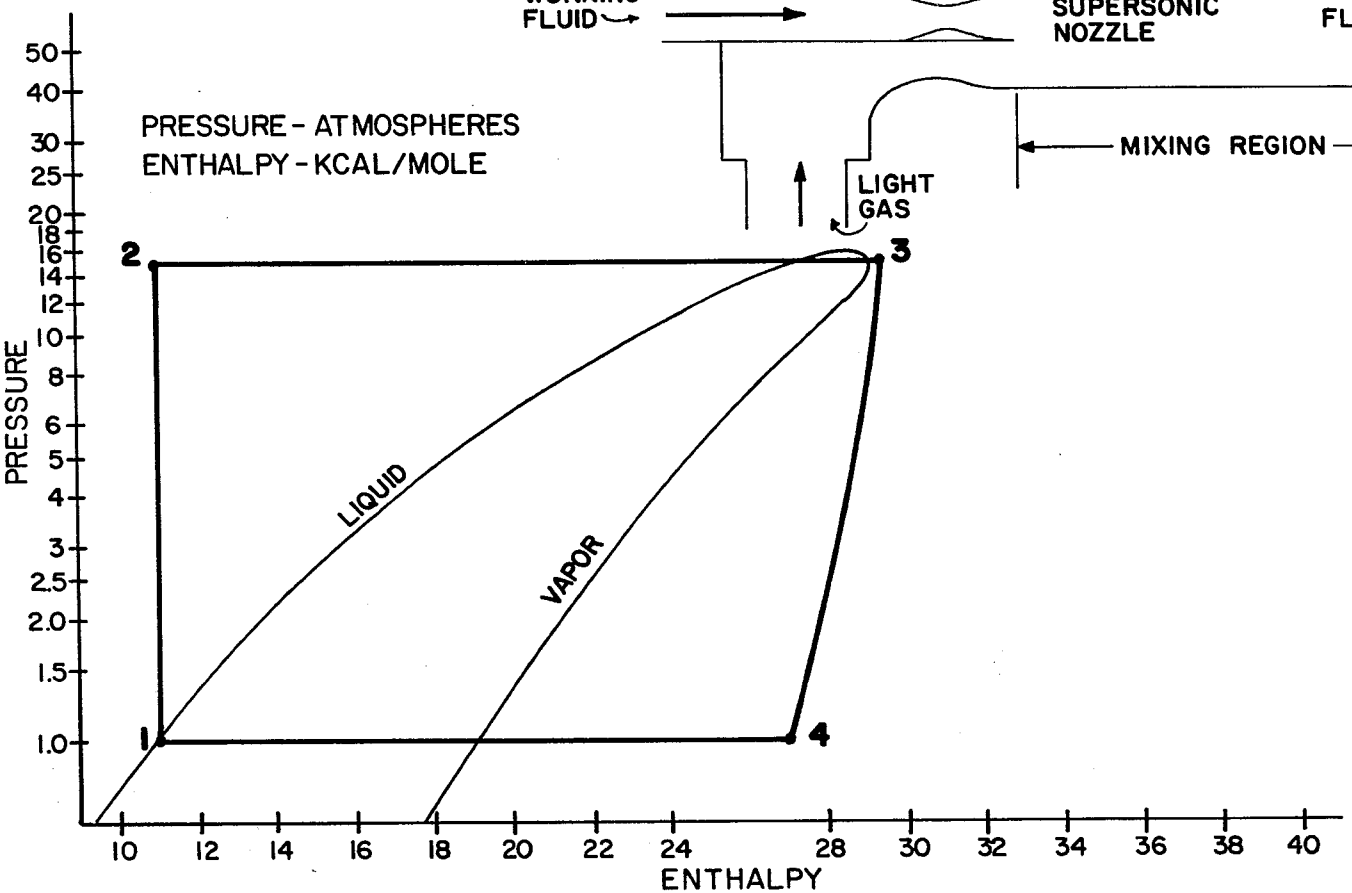
FIG. 6 is a diagram showing a Rankine cycle on a FC-75 pressure-enthalpy diagram.

FIG. 6 shows a Rankine power cycle on a FC-75 P-h diagram for an expansion to one atmosphere. The maximum efficiency that can be achieved with an ejector can be obtained from this diagram by multiplying the thermodynamic efficiency of the cycle by the ejector efficiency:

$$\eta = \frac{h_3 - h_4}{h_3 - h_2}\,\eta_{ej}$$

From the diagram we have:

$$h_3 - h_4 = 29.3 - 27.0 = 2.3 \text{ Kcal/mole}$$

and $$h_3 - h_2 = 29.3 - 11.0 = 18.3.$$

Thus, $$\eta = (2.3/18.3)\ 0.93 = 0.117.$$

As in the previous calculations, assume the following component efficiencies: Combustion 85%; Nozzle 96%; and Turbine 85%.

The overall product of these efficiencies is, therefore, 69.4 percent. Hence, the overall efficiency is $11.7\times 0.694 - 8.1\%$.

If the flow is expanded to 1/10 on an atmosphere, the thermodynamic efficiency can be raised to 21.1 percent while the ejector efficiency drops to 82 percent. Thus, $$\eta = 21.1\times 0.82 = 17.3\%.$$

Assuming the same component efficiencies as above, the overall efficiency can be calculated:

$$\eta = 17.3\times 0.694 = 12.0\%.$$

Although these efficiencies are low, they are higher than those that would be achieved with a partially admitted turbine such as would be used in certain applications.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention which is defined in the appended claims.

What is claimed is:

1. The process of extracting energy from a high-temperature high-pressure working fluid, comprising augmenting flow of the working fluid with a flow of gas from a source separate from the working fluid, utilizing some of the energy from the working fluid to induce addition and mixture of the gas thereinto and thereby to create a flow of the mixed fluids having a greater mass and lower temperature than the initial flow of working fluid, supplying the mixed fluids to a turbine for converting the energy in the mixed fluids into mechanical energy, and separating and recycling at least the augmenting gas from the fluid flow exhausted from the turbine.

2. The process defined in claim 1 wherein the working fluid has a molecular weight greater than the gas.

3. The process defined in claim 1, wherein the gas is selected from the group consisting of hydrogen, helium, nitrogen, air, water vapor, or an organic compound having a molecular weight less than the working fluid.

4. The process defined in claim 1, wherein the working fluid is selected from the group consisting of an inorganic element, an inorganic compound, or a fluorocarbon, and the selected fluid has a molecular weight greater than the gas.

5. A Rankine cycle augmented flow turbine engine comprising a source of high-temperature high-pressure working fluid providing the sole energy input to the engine, an ejector including a primary nozzle receiving working fluid from said source and a secondary nozzle connected to supply augmenting gas into said ejector, a turbine receiving a flow of lower temperature lower pressure mixed gas and working fluid from said ejector, a heat exchanger receiving the exhaust from said turbine and cooling the working fluid to liquid, and means directing the cooled augmenting gas back to said secondary nozzle and directing the liquid working fluid back to said source.

6. A turbine engine comprising a turbine having an inlet and an outlet for a flow of working fluid, an ejector having inlets for separate fluid flows, one inlet serving to induce inflow from the other, and having an outlet for the mixed inflow of fluids, a source of high temperature thermodynamic working fluid connected to said one inlet of said ejector, a source of gas separate from said working fluid and connected to said other inlet of said ejector to augment the mass flow of working fluid, said ejector outlet being connected to said turbine inlet, a heat exchanger having an inlet receiving mixed fluid from said turbine outlet and an outlet, a gas/liquid separator receiving the cooled fluids from said outlet of said heat exchanger and providing separate outlets for the cooled working fluid and the gas, and the gas outlet of said separator being connected to said other inlet of said ejector.

7. A turbine engine as defined in claim 6, wherein said source of working fluid is a vaporizer providing a means to add heat energy to the working fluid, said vaporizer having an inlet receiving cooled working fluid from said separator, whereby separate closed loops are provided for the working fluid and for the augmenting gas.

8. A turbine engine as defined in claims 6 or 7, wherein the working fluid has a molecular weight greater than the gas.

9. A turbine engine as defined in claims 6 or 7, wherein the gas is selected from the group consisting of hydrogen, helium, nitrogen, air, water vapor, or an organic compound having a molecular weight less than the working fluid.

10. A turbine engine as defined in claim 9, wherein the working fluid is mercury and the gas is selected from hydrogen or helium.

11. A turbine engine is defined in claim 9, wherein the working fluid is water and the gas is selected from hydrogen or helium.

12. A turbine engine as defined in claims 6 or 7, wherein the working fluid is selected from the group consisting of an inorganic element, an inorganic compound, or a fluorocarbon, the selected fluid having a molecular weight greater than the gas.

13. The turbine engine of claims 6, 7, or 8, in which said ejector has a primary supersonic nozzle receiving flow from said one inlet and has a secondary subsonic nozzle for receiving working fluid from said other inlet, in which the ratio of areas of said secondary to said primary nozzles is in the order of 100 to 1.

* * * * *